US010080263B2

(12) United States Patent
Hoehn et al.

(10) Patent No.: US 10,080,263 B2
(45) Date of Patent: Sep. 18, 2018

(54) COOKING DEVICE

(71) Applicant: Miele & Cie. KG, Guetersloh (DE)

(72) Inventors: Ruediger Hoehn, Hiddenhausen (DE); Timo Lippert, Bielefeld (DE); Carolin Kaudewitz, Rheda-Wiedenbrueck (DE); Micha Reifert, Buende (DE)

(73) Assignee: MIELE & CIE. KG, Guetersloh (DE)

( * ) Notice: Subject to any disclaimer, the term of this patent is extended or adjusted under 35 U.S.C. 154(b) by 291 days.

(21) Appl. No.: 14/831,887

(22) Filed: Aug. 21, 2015

(65) Prior Publication Data

US 2016/0066367 A1 Mar. 3, 2016

(30) Foreign Application Priority Data

Aug. 28, 2014 (DE) ..... 10 2014 112 354

(51) Int. Cl.

*H05B 6/64* (2006.01)
*H05B 6/80* (2006.01)
*H05B 6/76* (2006.01)
*F24C 15/04* (2006.01)

(52) U.S. Cl.

CPC ..... *H05B 6/6479* (2013.01); *F24C 15/04* (2013.01); *H05B 6/6402* (2013.01); *H05B 6/6414* (2013.01); *H05B 6/76* (2013.01); *H05B 6/763* (2013.01); *H05B 6/80* (2013.01)

(58) Field of Classification Search

CPC ..... F24C 15/04; H05B 6/6402; H05B 6/76; H05B 6/6479; H05B 6/763; H05B 6/80; H05B 6/6414

USPC ..... 219/678–763

See application file for complete search history.

(56) References Cited

U.S. PATENT DOCUMENTS 3,965,334 A * 6/1976 Asselman ..... F28D 15/0233 165/104.14
5,767,487 A * 6/1998 Tippmann ..... A23B 4/0526 219/440
8,076,616 B2 * 12/2011 Stanger ..... A47J 39/006 219/386

(Continued)

FOREIGN PATENT DOCUMENTS

DE 2848658 A1 5/1976
DE 3714122 A1 11/1988

(Continued)

*Primary Examiner* — Quang Van

(74) *Attorney, Agent, or Firm* — Leydig, Voit & Mayer, Ltd.

(57) ABSTRACT

A cooking appliance includes at least one housing assembly and at least one cooking chamber formed in the housing assembly. The at least one cooking chamber includes at least one loading opening. At least one cooking chamber door closes the at least one loading opening. The at least one cooking chamber door includes at least one frame assembly and at least one window assembly. The at least one frame assembly includes a plurality of edges, with at least one contact face at each of the edges on a side of the at least one cooking chamber door that faces the at least one cooking chamber when the at least one cooking chamber door is closed. At least one of the contact faces is an at least one extended contact face that is significantly larger than the remaining contact faces with respect to at least one geometric dimension.

32 Claims, 2 Drawing Sheets

(56) References Cited

U.S. PATENT DOCUMENTS

| | | | | |
|---|---|---|---|---|
| 2009/0188913 | A1* | 7/2009 | Kimura | H05B 6/6414 219/725 |
| 2012/0043318 | A1* | 2/2012 | Komuro | F24C 15/006 219/757 |

FOREIGN PATENT DOCUMENTS

| | | | |
|---|---|---|---|
| EP | 2037183 | A1 | 3/2009 |
| EP | 2747515 | A1 | 6/2014 |

* cited by examiner

COOKING DEVICE

CROSS-REFERENCE TO PRIOR APPLICATION

Priority is claimed to German Patent Application No. DE 10 2014 112 354.9, filed on Aug. 28, 2014, the entire disclosure of which is hereby incorporated by reference herein.

FIELD

The present invention relates to a cooking appliance comprising at least one housing assembly and at least one cooking chamber which is formed in the housing assembly and into which food can be introduced via at least one loading opening. The cooking chamber is associated with at least one microwave device for heating the food, it being possible to close the loading opening by means of at least one cooking chamber door. The cooking chamber door comprises at least one frame assembly and at least one window assembly.

BACKGROUND

Cooking appliances are often equipped with a plurality of functions and can therefore be used in a very varied and flexible manner. Inter alia, various modes of operation may be provided in a cooking appliance or other additional functions are made possible in a cooking appliance.

For this purpose, it may be necessary to provide a plurality of technical components on the cooking appliance. However, the available space for installing fixed or removable components is limited in a cooking appliance.

There are particular requirements regarding the arrangement of technical components in particular in a cooking appliance which can be used in microwave operation, since it must always be ensured that no microwave radiation escapes from the cooking chamber.

SUMMARY

A cooking appliance includes at least one housing assembly and at least one cooking chamber formed in the housing assembly. The at least one cooking chamber includes at least one loading opening and receives food introduced via the at least one loading opening. At least one microwave device is associated with the at least one cooking chamber and heats the food. At least one cooking chamber door closes the at least one loading opening. The at least one cooking chamber door includes at least one frame assembly and at least one window assembly. The at least one frame assembly includes a plurality of edges, with at least one contact face at each of the edges on a side of the at least one cooking chamber door that faces the at least one cooking chamber when the at least one cooking chamber door is closed. At least one of the contact faces is an at least one extended contact face that is significantly larger than the remaining contact faces with respect to at least one geometric dimension. The at least one extended contact face rests against a corresponding contact portion on the at least one housing assembly when the at least one cooking chamber door is closed. At least one stabilising device is associated with the at least one extended contact face.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
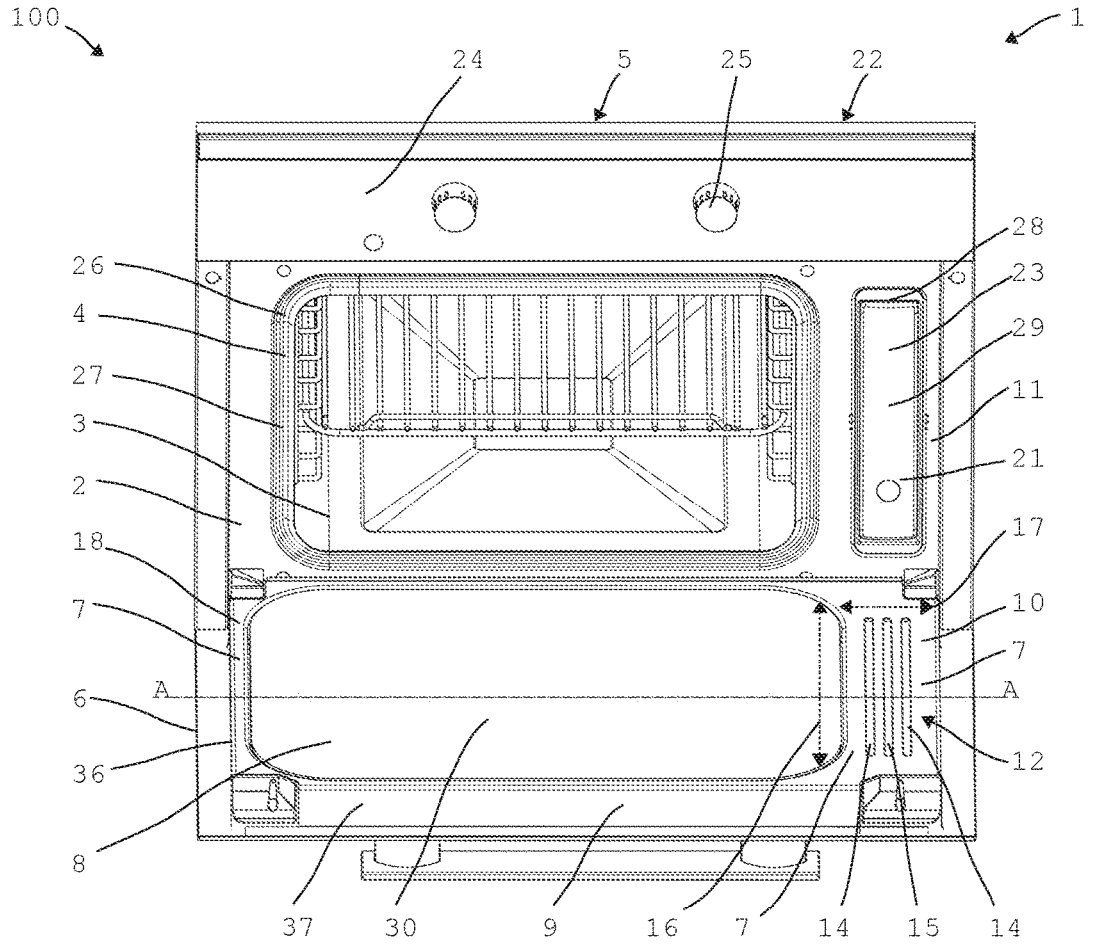
FIG. 1 is a purely schematic view of a cooking appliance according to the invention, when the cooking chamber door is open.

In an embodiment, the cooking appliance according to the invention comprises at least one housing assembly and at least one cooking chamber which is formed in the housing assembly. Food can be introduced into the cooking chamber via at least one loading opening and the cooking chamber is associated with at least one microwave device for heating the food. The loading opening can be closed by at least one cooking chamber door, the cooking chamber door comprising at least one frame assembly and at least one window assembly. The frame assembly comprises at least one extended contact face on the side which faces the cooking chamber when the cooking chamber door is closed, which contact face rests against a corresponding contact portion on the housing assembly when the cooking chamber door is closed. Furthermore, at least one stabilising device is associated with the extended contact face.

In an embodiment, the at least one frame assembly has a plurality of edges and comprises at least one contact face at each of the edges. The at least one frame assembly also comprises at least one extended contact face on the side of the at least one cooking chamber door that faces the at least one cooking chamber when the at least one cooking chamber door is closed. The extended contact face is significantly larger than the remaining contact faces with respect to at least one geometric dimension. In particular, "significantly larger" could mean that the extended contact face has a surface area that is at least twice as large and/or a width or transverse extension that is at least twice as great as that of the smallest contact face in each case.

In an embodiment, the extended contact face is arranged on a side edge of the at least one frame assembly, rather than a top edge or a bottom edge (in relation to the at least one cooking chamber) of the at least one frame assembly.

According to the invention, the loading opening is closed by the cooking chamber door, in particular in a substantially radiation-tight manner.

Preferably, the contact portion of the housing assembly receives appliance components which are either provided in a fixed manner on the contact portion or which may also be arranged so as to be removable.

According to the invention, the frame assembly refers to the entire cooking chamber door apart from the window assembly. The frame assembly may comprise, inter alia, rails, cladding surfaces, and optionally built-in joints or hinges.

According to the invention, the window assembly in particular comprises all the components of a viewing window in the cooking chamber door. These also include, in particular, the panes providing the viewing window, seals, and preferably also a perforated plate which acts as a microwave trap for the viewing window.

The contact face particularly preferably rests in an even and defined manner on the contact portion of the housing assembly. Particularly effective and reliable sealing of the cooking chamber is achieved by this type of exact arrangement of the door or the contact face on the contact portion.

According to the invention, a stabilising device means that the contact face is stabilised, by means of additional components or by machining the contact face, in such a way that, despite the extent thereof, the contact face is rigid during use and cannot become distorted.

The cooking appliance according to the invention provides a number of advantages. One significant advantage is that, due to the particular design of the cooking chamber door having the extended contact face and the corresponding contact portion on the housing assembly, a portion for arranging technical components can be provided, the stabilising device on the contact face nonetheless permitting secure sealing of the cooking chamber door against microwave radiation.

The stabilising device effectively prevents the extended contact face of the cooking chamber door from becoming distorted or warped during opening, closing or generally during operation, with the result that there is no longer any peripheral spacing between the door and the loading opening. In the worst case, microwave radiation could then escape from the cooking chamber. This is effectively and reliably prevented by the design according to the invention of the cooking appliance.

The stabilising device preferably comprises at least one metal sheet. In this case, in particular an additional component is provided, which is received on or fixed to the contact face. Thus for example an additional metal sheet, a metal strip or also rods for reinforcement can be glued, welded, soldered or sintered onto the contact face, in particular from the inside of from behind. Double sheet thickness in the region of the contact face, for example, is thereby achieved in a simple manner, as a result of which the contact face is made more rigid during use. In particular if the metal sheet is provided on the contact face from behind or from the inside, the visual appearance of the door is not adversely affected.

Particularly preferably, the stabilising device is formed integrally with the contact face. In this case, stabilisation on the contact face can be achieved by machining the material of the contact face, without additional components having to be provided.

In advantageous developments, the stabilising device is provided by means of at least one deformation of the contact face. In this case, deformation of the contact face increases the stability of the contact face, at least in at least one direction. The stability of the contact face is thus increased, in particular along the longitudinal extension of the deformation.

In expedient embodiments, at least two deformations are provided, which are in particular arranged substantially in parallel with one another. It is thereby possible to also stabilise large regions or the entire contact face, with the result that a contact face is provided which is rigid during use and is sturdy.

Preferably, the deformation is formed by at least one embossed portion in the contact face. In this case, the embossed portion is formed in particular as a bead and can preferably be produced in the contact face by means of a deep-drawing process. Forming an embossed portion in the contact face stabilises said face along the longitudinal extension of the embossed portion, since bending or buckling of the contact face in the region of the embossed portion is made more difficult.

In an embodiment, the embossed portion comprises a concave groove that is formed in the extended contact face. The groove has a width and a cross section in the shape of a segment of a circle, the radius of which is equal to or greater than the groove width. As a result, it may be easier to clean the inside face of the cooking chamber door.

In order to provide a particularly stable contact face, the contact face particularly preferably has a longitudinal extension and a transverse extension, at least one deformation extending along the longitudinal extension of the contact face. In this case, the longitudinal extension of the contact face is in particular longer than the transverse extension of the contact face.

In an embodiment, the extended contact face has, on one edge of the at least one frame assembly, a transverse extension that is oriented substantially orthogonally to the edge and is larger than, in particular at least twice as large, as a transverse extension of a contact face at another edge of the at least one frame assembly. Preferably, the extended contact fact has a transverse extension of at least 3 centimeters, and more preferably a transverse extension of at least 5 centimeters, but at most 20 centimeters.

Preferably, the frame assembly is associated with, at least in portions, at least one wave trap device, the frame assembly not comprising any wave trap device on the extended contact face. A wave trap device of this type is preferably configured as a microwave trap and in particular as a $\lambda/4$ trap, which is particularly preferably provided around the periphery of the loading opening of the cooking chamber when the cooking chamber door is closed. In order to provide an effective wave trap device, it is necessary for there to be a defined spacing between the closed cooking chamber door and the loading opening. In order for said defined spacing not to be able to change in the region of the extended contact face, the extended contact face is associated with at least one stabilising device.

In an embodiment, the wave trap device is arranged on a side of the extended contact face that faces the centre of the cooking chamber door.

In expedient developments, at least one cavity adjoins the contact face, at least in portions, in the inside of the cooking chamber door. In an embodiment of this kind, the extended contact face may, under some circumstances, not be sufficiently stabilised by other door components, meaning that the provision of the stabilising device on the contact face can be advantageous.

The contact face of the cooking chamber door preferably consists, at least in portions, of a metal sheet, and in particular of a Cr—Ni steel sheet. In particular, the entire frame assembly or the visible components of the frame assembly consist of a Cr—Ni steel sheet of this type. It is thus possible to provide a visually attractive and, in addition, robust and easy-to-clean surface for the cooking chamber door. In particular, Cr—Ni steel further has two expedient properties, meaning that a cooking chamber door of this type is also suitable for operation of the cooking appliance using a steam generation device. Cr—Ni steel is impervious to moisture and does not rust, and is in addition microwave-resistant.

Preferably at least one technical component is associated with the contact portion and in particular forms the contact portion, at least in regions. An installation surface is thus provided beside the cooking chamber, which surface can receive the various technical components.

In an embodiment, the technical component is a device that is accessible for the user of the cooking appliance. The user interacts with the technical component, for example if said component is a control panel. The user can handle the technical component, for example if said component is a removable water reservoir. The technical component is therefore to be understood as meaning that easy access by the user is required, although for design and/or functional reasons the technical component is preferably arranged so as to be covered the at least one cooking chamber door.

In an embodiment, the technical component is arranged on a side edge of the at least one housing assembly, rather than a top edge or a bottom edge (in relation to the at least one cooking chamber) of the at least one housing assembly, so as to correspond to the extended contact face. Since installed cooking appliances typically have installation dimensions having a width of approximately 60 cm and a height of 45 cm, arranging the technical component on the side reduces the width of the cooking chamber of the cooking appliance, but in fact only the largest extension of the cooking chamber is reduced. Thus, in contrast with reducing the height of the cooking chamber, arranging the technical component on a side edge of the at least one housing assembly preserves width-to-height ratios that are easier to use with respect to the cooking chamber opening and the surface available for the technical component.

In an embodiment, the at least one technical component is arranged in the contact portion and to the outside of the wave trap device when the cooking chamber door is closed. As a result, the waves produced by the at least one microwave device cannot influence the technical component.

Particularly preferably, at least one steam generation device is associated with the cooking chamber, which device is suitable and designed for supplying steam to the cooking chamber. It is thereby possible for the cooking appliance to be used in microwave operation and/or in steam operation, with the result that a particularly flexible cooking appliance is provided.

Preferably at least one water reservoir for the steam generation device is provided in the contact portion of the housing assembly. In this case, the front of the water reservoir can preferably end in a manner flush with the contact portion or may also be provided so as to be set back. If the water reservoir does not end in a manner flush with the contact face, a cover flap may be provided for example, which flap covers the water reservoir and forms the contact portion.

The water reservoir of the steam generation device particularly preferably forms the contact portion, at least in regions. In this case, the water reservoir is preferably designed in such a way that, in the inserted state, the front of the water reservoir forms a substantially flush surface with the contact portion.

In an embodiment, the technical component is the water reservoir, which may or may not be removable. The water reservoir supplies water to the steam generation device during operation of the cooking appliance.

In an embodiment, the transverse extension of the extended contact face is preferably greater than or equal to the width of the technical component, in particular of the water reservoir.

FIG. 1 is a purely schematic front view of a cooking appliance 1 according to the invention. The cooking appliance 1 shown is designed, in the embodiment shown here, as a combination cooking appliance 100, which comprises a microwave device 5 and a steam generation device 22.

The cooking appliance 1 comprises a housing assembly 2, in which a cooking chamber 3 is formed. The cooking chamber 3 comprises a loading opening 4, through which food to be cooked can be introduced into the cooking chamber 3. The loading opening 4 of the cooking chamber 3 can be closed by a cooking chamber door 6, said cooking chamber door 6 being shown in the open position in FIG. 1.

Food introduced into the cooking chamber 3 can be cooked by means of the microwave device 5 and/or the steam generation device 22 in microwave operation and/or in steam operation. The individual functions and settings of the cooking appliance 1 can be adjusted by means of a control panel 24 which, in the embodiment shown here, is arranged above the cooking chamber 3 and comprises control elements 25.

During operation of the cooking appliance 1, the cooking chamber 3 can be closed by means of the cooking chamber door 6. So that no steam can escape from the cooking chamber 3 during steam operation, a sealing device 26 surrounding the loading opening 4 is provided, which device is formed as a rubber seal or a silicone seal 27. In order to prevent the escape of microwave radiation which has been introduced into the cooking chamber, a microwave trap device 18 is additionally provided in the cooking chamber door 6, which device is shown in greater detail in FIG. 2.

In the embodiment shown here, a contact portion 11 is provided on the right-hand side next to the cooking chamber 3, on which portion technical components 21 can be provided. The contact portion 11 and the technical components 21 are accessible when the cooking chamber door 6 is open, and are covered by the cooking chamber door 6 in the closed state. Thus, when the cooking chamber door 6 is closed, a visually attractive appearance is achieved, the technical components 21 being easily accessible when the cooking chamber door is open.

The technical components 21 may be fixed to the contact portion 11 or may also be provided thereon so as to be removable. In the embodiment shown here, a receiving shaft 28 for the water reservoir 23 of the steam generation device is provided on the contact portion 11.

In this case, the water reservoir 23 is formed and arranged in the receiving shaft 28 in such a way that, in the inserted state of the water reservoir 23, the front 29 of the water reservoir 23 forms a substantially flush surface with the contact portion 11.

In the embodiment shown here, the cooking chamber door 6 comprises a frame assembly 7 and a window assembly 8. The window assembly 8 provides a viewing window 30. The frame assembly 7 comprises all the components of the door which are not provided by the viewing window 30. The frame assembly 7 in particular comprises the rails 36 and the cover elements 37.

An extended contact face 10 is provided on the side 9 of the cooking chamber door 6 which faces the cooking chamber 3 when the cooking chamber door 6 is closed, which extended contact face 10 rests in a substantially flush manner against the contact portion 11 of the housing assembly when the cooking chamber door 6 is closed. In order to effectively prevent the escape of microwave radiation from the cooking chamber 3, it must be ensured that the extended contact face 10 does not bend or warp. In this way, a constant spacing between the closed cooking chamber door 6 and the contact portion 11 can be ensured in a reliable and permanent manner.

Since, in the embodiment shown here, the door 6 is designed so as to be substantially hollow in the region of the extended contact face 10, the extended contact face 10 is not supported by any of the components of the cooking chamber door. Therefore, a stabilising device 12 is provided on the extended contact face 10, which device reinforces the extended contact face 10 and so permanent and reliable contact between the extended contact face 10 and the contact portion 11 is ensured.

In the embodiment shown, the stabilising device 12 is provided by three deformations 14 which are formed as embossed portions 15. The three embossed portions 15 are arranged substantially in parallel with one another and, in this case, are produced in the extended contact face 10 by means of a deep-drawing process. The stabilising device 12 is thus formed integrally with the extended contact face 10. In other embodiments, the stabilising device may, however, also be provided by at least one separate component.

The extended contact face 10 has a longitudinal extension 16 and a transverse extension 17, the longitudinal extension 16 being longer than the transverse extension 17. The deformations 14 or the embossed portions 15 extend, in the embodiment shown here, along the longitudinal extension 16 of the extended contact face 10. As a result, the extended contact face 10 is more warp-resistant, in particular in the direction of the longitudinal extension 16, than without the stabilising device 12.

As a result of the stabilising device, the extended contact face 10 is not distorted by opening and closing the cooking chamber door 6, even after long and intensive use, in such a way that clear contact between the extended contact face 10 and the contact portion 11 would no longer be ensured. Microwave-tight sealing of the cooking chamber 3 by the cooking chamber door 6 would then, under certain circumstances, no longer be ensured. This is prevented by the cooking appliance 1 according to the invention.

Figure 2:
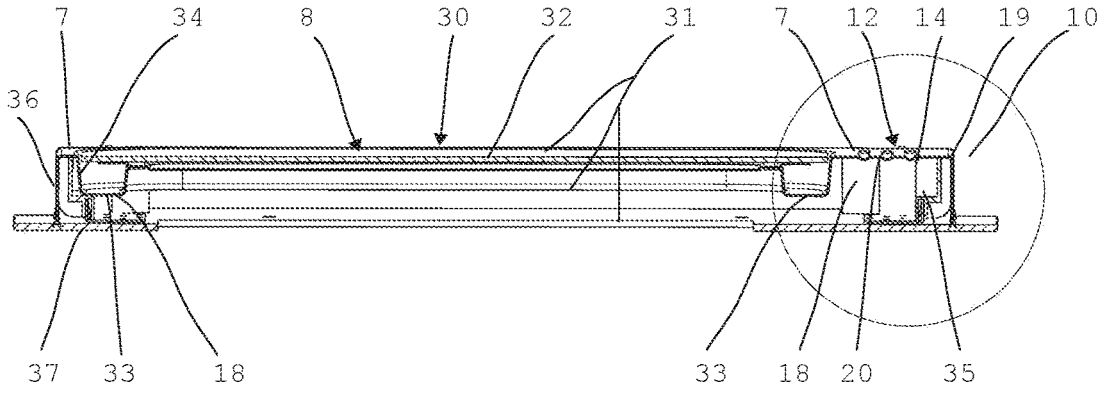
FIG. 2 is a purely schematic cross section through a cooking chamber door of a cooking appliance according to the invention.

In FIG. 2, the cooking chamber door according to FIG. 1 is shown in a purely schematic manner in a cross section along the sectional plane A-A. It is possible to see the cooking chamber door 6, which comprises the frame assembly 7 and the window assembly 8. The window assembly 8 forms a viewing window 30, which comprises a plurality of panes 31 and a perforated plate 32 as a microwave trap.

A wave trap device 18 is provided in the frame assembly 7, which trap device is designed as a microwave trap 33 in the embodiment shown here. In this case, the design of the microwave trap 30 corresponds to that of a λ/4 trap 34. The microwave trap 33 is provided in the cooking chamber door 6 in such a way as to rest against the housing assembly 2 of the cooking appliance 1, in a manner surrounding the loading opening 4, when the cooking chamber door 6 is closed.

It can be seen on the right-hand side of the cooking chamber door 6 that a microwave trap device 18 is no longer provided in the region of the extended contact face 10. For secure, microwave-tight sealing of the cooking chamber 3, it is necessary for the microwave trap 33 of the cooking chamber door 6 to always rest against the housing assembly 2 of the cooking appliance 1 at a defined spacing. In order to ensure this, it is necessary to reinforce the extended contact face 10.

Since, in the embodiment shown here, the cooking chamber door 6 is designed so as to be hollow adjacent to the extended contact face 10, the extended contact face 10 cannot be supported on components of the door 6. A stabilising device 12 is therefore provided on the extended contact face 10, which device is formed by three deformations 14 in this case. By means of said deformations 14, which are configured as embossed portions 15, the extended contact face 10 is sufficiently stabilised for the cooking chamber door 6 to be stabilised in this region in such a way that clear contact between the microwave trap device 18 and the housing assembly 2 of the cooking appliance 1 is ensured.

Figure 3:
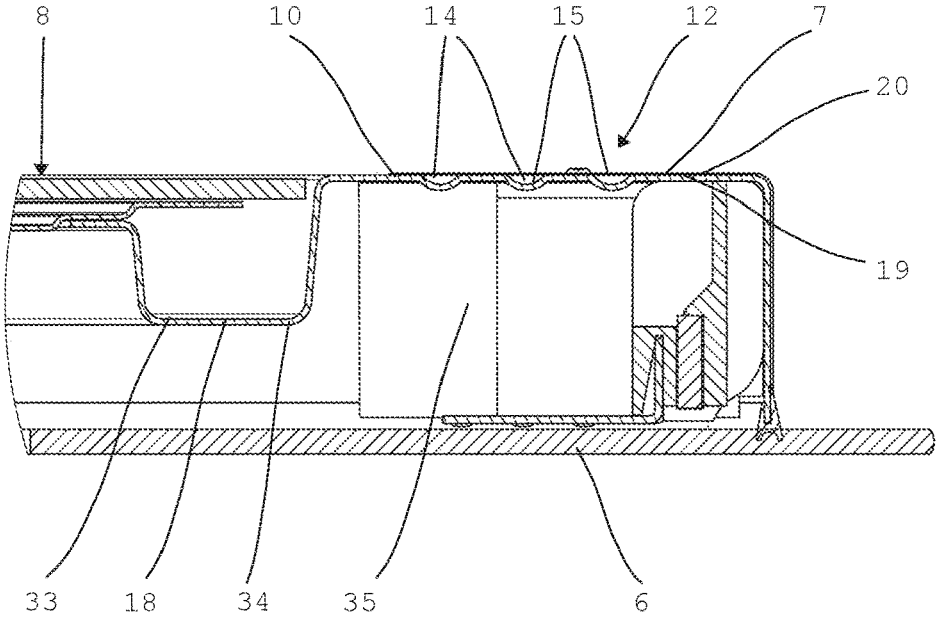
FIG. 3 is an enlarged view of the marked region from FIG. 2.

The right-hand region of the cooking chamber door 6 according to FIG. 2, which is marked by a circle, is shown in a purely schematic manner in an enlarged view in FIG. 3. Here, too, it is possible to see the window assembly 8 and the frame assembly 7 of the cooking chamber door 6. On the left-hand side, next to the extended contact face 10, it is possible to see the microwave trap device 18, which is designed as a microwave trap 33 in the form of a λ/4 trap 34.

A cavity 35 is provided below the extended contact face 10, such that the metal sheet 19 of the extended contact face 10 cannot be supported on components of the cooking chamber door 6. In this case, the metal sheet 19 is provided as a Cr—Ni radiation plate 20. Preferably, at least all the sheet parts of the cooking chamber door 6 which face the cooking chamber are produced from Cr—Ni radiation plate 20.

A Cr—Ni radiation plate 20 has the advantage of being visually attractive, relatively easy to work and, in addition, is resistant to moisture. This is advantageous in particular when using a combination cooking appliance 100 having a steam generation device 22, since a Cr—Ni radiation plate does not rust. Furthermore, a Cr—Ni radiation plate is microwave-resistant.

In the enlarged view of FIG. 3, it is possible to see the stabilising device 12, which consists of three deformations 14. In this ease, the deformations 14, which are formed as embossed portions 15, have been produced in the extended contact face 10 by means of a deep-drawing process. The contact face is stabilised along the longitudinal extension 16 of the extended contact face 10 by means of the embossed portions 15.

Figure 4:
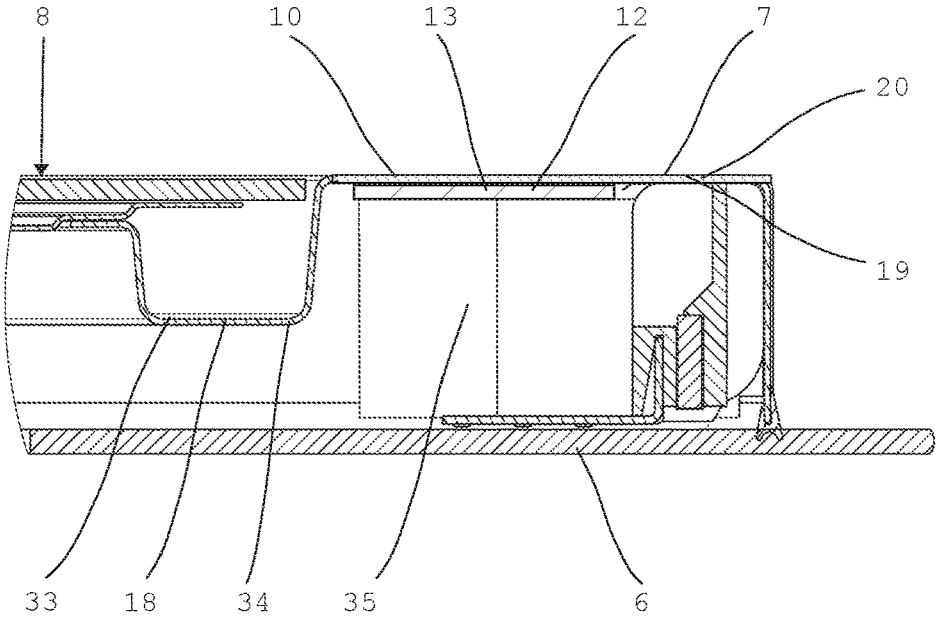
FIG. 4 shows the region shown in FIG. 3 of a cooking appliance according to the invention, in another embodiment.

FIG. 4 is a purely schematic cross section of the region of a cooking chamber door according to FIG. 3, in another embodiment of the cooking appliance according to the invention. In this case, the stabilising device 12 is designed here as a separate component.

In the embodiment shown here, the stabilising device is provided by a separate metal sheet 19, which is provided here on the extended contact face 10 from the inside or from behind. The extended contact face 10 is sufficiently stabilised by means of the metal sheet 19.

An embodiment of this kind also achieves a visually attractive result, in which the extended contact face 10 is stabilised against warping and/or bending.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 Cooking appliance
2 Housing assembly
3 Cooking chamber
4 Loading opening
5 Microwave device
6 Cooking chamber door
7 Frame assembly
8 Window assembly
9 Side
10 Contact face
11 Contact portion
12 Stabilising device
13 Metal sheet
14 Deformation
15 Embossed portion
16 Longitudinal extension
17 Transverse extension
18 Wave trap device
19 Metal sheet
20 Cr—Ni steel sheet
21 Technical component
22 Steam generation device
23 Water reservoir
24 Control panel
25 Control element
26 Sealing device
27 Rubber seal/silicone seal
28 Receiving shaft
29 Front
30 Viewing window
31 Pane
32 Perforated plate
33 Microwave trap
34 λ/4 trap
35 Cavity
36 Rail
37 Cover element
100 Combination cooking appliance

What is claimed is:

1. A cooking appliance, comprising:

at least one housing assembly;

at least one cooking chamber formed in the housing assembly, the at least one cooking chamber including at least one loading opening and being configured to receive food introduced via the at least one loading opening;

at least one microwave device associated with the at least one cooking chamber and configured to heat the food; and at least one cooking chamber door configured to close the at least one loading opening, the at least one cooking chamber door comprising at least one frame assembly and at least one window assembly, wherein the at least one frame assembly comprises a plurality of edges, at least one contact face at each of the edges on a side of the at least one cooking chamber door that faces the at least one cooking chamber when the at least one cooking chamber door is closed, at least one of the contact faces being an at least one extended contact face that is significantly larger than the remaining contact faces with respect to at least one geometric dimension, the at least one extended contact face being configured to rest against a corresponding contact portion on the at least one housing assembly when the at least one cooking chamber door is closed, wherein at least one stabilising device is provided on the at least one extended contact face so as to reinforce the at least one extended contact face, the cooking appliance farther comprising at least one technical component associated with the corresponding contact portion, wherein at least in regions the at least one technical component forms the corresponding contact portion.

2. The cooking appliance of claim 1, wherein the at least one stabilising device comprises at least one metal sheet.

3. The cooking appliance of claim 1, wherein the at least one stabilising device is formed integrally with the at least one extended contact face.

4. The cooking appliance of claim 1, wherein the at least one stabilising device comprises at least one deformation of the at least one extended contact face.

5. The cooking appliance of claim 4, wherein the at least one stabilising device comprises at least two deformations arranged substantially in parallel with one another.

6. The cooking appliance of claim 4, wherein the at least one deformation is formed by at least one embossed portion in the at least one extended contact face.

7. The cooking appliance of claim 6, wherein the at least one embossed portion comprises a concave groove.

8. The cooking appliance of claim 4, wherein the at least one extended contact face has a longitudinal extension and a transverse extension, the at least one deformation extending along the longitudinal extension.

9. The cooking appliance of claim 1, wherein at least a portion of the at least one frame assembly is associated with at least one wave trap device disposed somewhere other than on the at least one extended contact face.

10. The cooking appliance of claim 9, wherein the at least one wave trap device is arranged on a side of the at least one extended contact face that faces the centre of the at least one cooking chamber door.

11. The cooking appliance of claim 9, wherein at least one technical component is arranged in the corresponding contact portion and to the outside of the at least one wave trap device when the at least one cooking chamber door is closed.

12. The cooking appliance of claim 1, wherein the at least one cooking chamber door comprises at least one cavity that adjoins at least a portion of the at least one extended contact face.

13. The cooking appliance of claim 1, wherein at least a portion of the at least one extended contact face comprises a metal sheet.

14. The cooking appliance of claim 13, wherein the metal sheet comprises a Cr—Ni steel sheet.

15. The cooking appliance of claim 1, wherein at least one steam generation. device is associated with the at least one cooking chamber, the at least one steam generation device being configured to supply steam to the at least one cooking chamber.

16. The cooking appliance of claim 15, wherein the at least one steam generation device comprises at least one water reservoir disposed in the corresponding contact portion.

17. The cooking appliance of claim 16, wherein at least in regions the at least one water reservoir forms the corresponding contact portion.

18. The cooking appliance of claim 1, wherein the at least one extended contact face is arranged on a. side edge of the at least one frame assembly.

19. The cooking appliance of claim 1, wherein the at least one extended contact face has a transverse extension that is oriented substantially orthogonally to one of the plurality of edges of the at least one frame assembly.

20. The cooking appliance of claim 19, wherein the transverse extension of the at least one extended contact face is larger than a transverse extension of one of the remaining contact faces at another of the plurality of edges of the at least one frame assembly.

21. The cooking appliance of claim 19, wherein the transverse extension of the at least one extended contact face is at least twice as large as a transverse extension of one of the remaining contact faces at another of the plurality of edges of the at least one frame assembly.

22. The cooking appliance of claim 19, wherein the at least one extended contact face has a transverse extension of at least 3 centimeters.

23. The cooking appliance of claim 22, wherein the at least one extended contact face has a transverse extension of at least 5 centimeters but at most 20 centimeters.

24. The cooking appliance of claim 1, wherein the at least one technical component is configured so as to be accessible to a user of the cooking appliance.

25. The cooking appliance of claim 1, wherein the at least one technical component is arranged so as to be covered by the at least one cooking chamber door when the at least one cooking chamber door is closed.

26. The cooking appliance of claim 1, wherein the at least one technical component is arranged on a side of the at least one housing assembly.

27. The cooking appliance of claim 1, wherein the at least one technical component comprises at least one water reservoir configured to supply water to at least one steam generation device associated with the at least one cooking chamber, the at least one steam generation device being configured to supply steam to the at least one cooking chamber.

28. The cooking appliance of claim 27, wherein the at least one water reservoir is configured so as to be removable from the cooking appliance.

29. The cooking appliance of claim 1, wherein the at least one extended contact face has a transverse extension that is greater than or equal to a width of the at least one technical component.

30. The cooking appliance of claim 29, wherein the at least one technical component comprises at least one water reservoir.

31. A cooking appliance, comprising:

at least one housing assembly;

at least one cooking chamber formed in the housing assembly, the at least one cooking chamber including at least one loading opening and being configured to receive food introduced via the at least one loading opening;

at least one microwave device associated with the at least one cooking chamber and configured to heat the food; and at least one cooking chamber door configured to close the at least one loading opening, the at least one cooking chamber door comprising at least one frame assembly and at least one window assembly, wherein the at least one frame assembly comprises a plurality of edges, at least one contact face at each of the edges on a side of the at least one cooking chamber door that faces the at least one cooking chamber when the at least one cooking chamber door is closed, at least one of the contact faces being an at least one extended contact face that is significantly larger than the remaining contact faces with respect to at least one geometric dimension, the at least one extended contact face being configured to rest against a corresponding contact portion on the at least one housing assembly when the at least one cooking chamber door is closed, wherein at least one stabilising device is provided on the at least one extended contact face so as to reinforce the at least one extended contact face, wherein the at least one extended contact face has a transverse extension that is oriented substantially orthogonally to one of the plurality of edges of the at least one frame assembly, and wherein the transverse extension of the at least one extended contact face is at least twice as large as a transverse extension of one of the remaining contact faces at another of the plurality of edges of the at least one frame assembly.

32. A cooking appliance, comprising:

at least one housing assembly;

at least one cooking chamber formed in the housing assembly, the at least one cooking chamber including at least one loading opening and being configured to receive food introduced via the at least one loading opening;

at least one microwave device associated with the at least one cooking chamber and configured to heat the food; and at least one cooking chamber door configured to close the at least one loading opening, the at least one cooking chamber door comprising at least one frame assembly and at least one window assembly, wherein the at least one frame assembly comprises a plurality of edges, at least one contact face at each of the edges on a side of the at least one cooking chamber door that faces the at least one cooking chamber when the at least one cooking chamber door is closed, at least one of the contact faces being an at least one extended contact face that is significantly larger than the remaining contact faces with respect to at least one geometric dimension, the at least one extended contact face being configured to rest against a corresponding contact portion on the at least one housing assembly when the at least one cooking chamber door is closed, wherein at least one stabilising device is provided on the at least one extended contact face so as to reinforce the at least one extended contact face, wherein at least one steam generation device is associated with the at least one cooking chamber, the at least one steam generation device being configured to supply steam to the at least one cooking chamber, wherein the at least one steam generation device comprises at least one water reservoir disposed in the corresponding contact portion, and wherein at least in regions the at least one water reservoir forms the corresponding contact portion.

* * * * *